US006495997B2

(12) United States Patent
Hall et al.

(10) Patent No.: US 6,495,997 B2
(45) Date of Patent: Dec. 17, 2002

(54) HIGH IMPEDANCE CURRENT MODE VOLTAGE SCALABLE DRIVER

(75) Inventors: Garrett W. Hall, Portland, OR (US); Andrew M. Volk, Granite Bay, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/895,285

(22) Filed: Jun. 29, 2001

(65) Prior Publication Data

US 2002/0109493 A1 Aug. 15, 2002

Related U.S. Application Data

(60) Provisional application No. 60/269,068, filed on Feb. 15, 2001.

(51) Int. Cl.[7] ..... G05F 3/16
(52) U.S. Cl. ..... 323/316
(58) Field of Search ..... 323/312, 313, 323/314, 315, 316, 317; 327/530, 534, 535, 538, 539

(56) References Cited

U.S. PATENT DOCUMENTS 4,829,258 A * 5/1989 Volk et al. ..... 328/155
5,113,129 A * 5/1992 Hughes ..... 323/316
5,815,107 A * 9/1998 Frankeny et al. ..... 34/159

OTHER PUBLICATIONS

U.S. patent application Ser. No. 09/001,716 filed Dec. 3, 1997.
U.S. patent application Ser. No. 09/021,609 filed Feb. 10, 1998.
http://www.jedec.org/download/search/jes8–9a.pdf "Stub Series Terminated Logic for 2.5 V (SSTL_2)" JEDEC Standard, JESD8–9A.
http://www.jedec.org/download/search/jesd8–6.pdf "High Speed Transceiver Logic (HSTL) A 1.5 V Output Buffer Supply Voltage Based Interface Standard for Digital Integrated Circuit s" EIA/JEDEC Standard, EIA/JESD8–6.
Tien–Yu Wu et al; "A Low Glitch 10–bit 75–MHz CMOS Video D/A Converter" Solid–State Circuits, IEEE Journal of, vol. 30 Issue: 1, Jan. 1995, pp. 68–72.

* cited by examiner

*Primary Examiner*—Matthew Nguyen
(74) *Attorney, Agent, or Firm*—Blakely, Sokoloff, Taylor & Zafman LLP

(57) ABSTRACT

A high impedance current mode voltage scalable driver allows signals from a higher supply voltage platform to transition to lower supply platforms. The scalable driver uses a current source to provide high impedance onto a load coupled to the driver. The driving of the load by the current source is controlled by symmetrical switches which are operated by the transition of the input signal. The driver utilizes voltage scaling to allow a particular higher supply voltage platform to transition to a variety of lower supply voltage platforms.

20 Claims, 9 Drawing Sheets

HIGH IMPEDANCE CURRENT MODE VOLTAGE SCALABLE DRIVER

RELATED APPLICATIONS

This application claims priority from U.S. Provisional Patent Application Ser. No. 60/269,068, entitled "High Impedance Current Mode Voltage Scalable Driver" filed Feb. 15, 2001.

FIELD OF THE INVENTION

The present invention relates to the field of signal conversion and, more particularly, to circuits to scale signal voltage.

BACKGROUND OF THE RELATED ART

In a number of situations, a signal voltage will need to be reduced in order to couple the signal to the next circuit. Although a voltage divider network or circuit can provide a requisite step down in the voltage level of the signal, in certain applications such voltage divider reduction may not provide the adequate performance needed for the driven circuit. When the driven circuit operates at a substantially lower voltage then the driving circuit, a simple voltage divider reduction could introduce significant jitter and skew at the input of the driven circuit. For example, when the signal is a clocking signal and the driven circuit is a processor operating at a sufficiently fast speed, performance problems could be encountered if a reduction of the clocking signal is needed at the input of the processor. State of the art processors of today operate at input clock frequencies of 100 MHz or higher and these clock frequencies are multiplied within the processor chip itself. At these higher frequencies of operation, the processors may operate near or below 1.0 volt level. This is especially true of processors utilized for mobile applications where lower supply voltage for the processor core is imperative in order to conserve battery life.

Although the processor technology has developed to improve the performance of the processors, clock generators have not improved upon the technology to produce lower voltage clocking circuitry. Part of the reason stems from the fact that lower voltage circuits typically are more expensive to manufacture than circuitry utilizing higher supply voltages. Accordingly, many clock vendors continue to produce clock generator chips operating at the supply voltages around 3.3 volts. In order to utilize a 3.3 volt clocking signal to drive a processor operating at a supply voltage of around 1.0 volt or below, the clock signal will need to be reduced to a fraction of its output level in order to drive the processor. Since rail-to-rail transition is much smaller for the reduced voltage signal, jitter at the input is more noticeable during the transition. Although it is possible to increase the slew rate by implementing a large device, a significant increase in the slew rate will most likely introduce undesirable electromagnetic interference (EMI) and in some instances this EMI level is beyond standards permitted for the computing devices at low voltage, it is difficult to increase the slew rate.

As a further problem, some form of over-voltage protection is typically desirable in order to prevent an accidental increase in the input voltage which could damage the processor. Additionally, if the supply operating voltage of the processor drops below a volt (for example, to 0.9 volts) the processor supply voltage is approaching the threshold voltage of the clocking circuit, so that adequate signal transition may be impaired due to the closeness of the supply voltage of the processor to the threshold turn on voltage of the circuitry of the clock generator. Accordingly, for various reasons noted, a solution is needed, especially for lower supply voltage devices, such as the example processor described above.

DETAILED DESCRIPTION OF THE INVENTION

Figure 1:
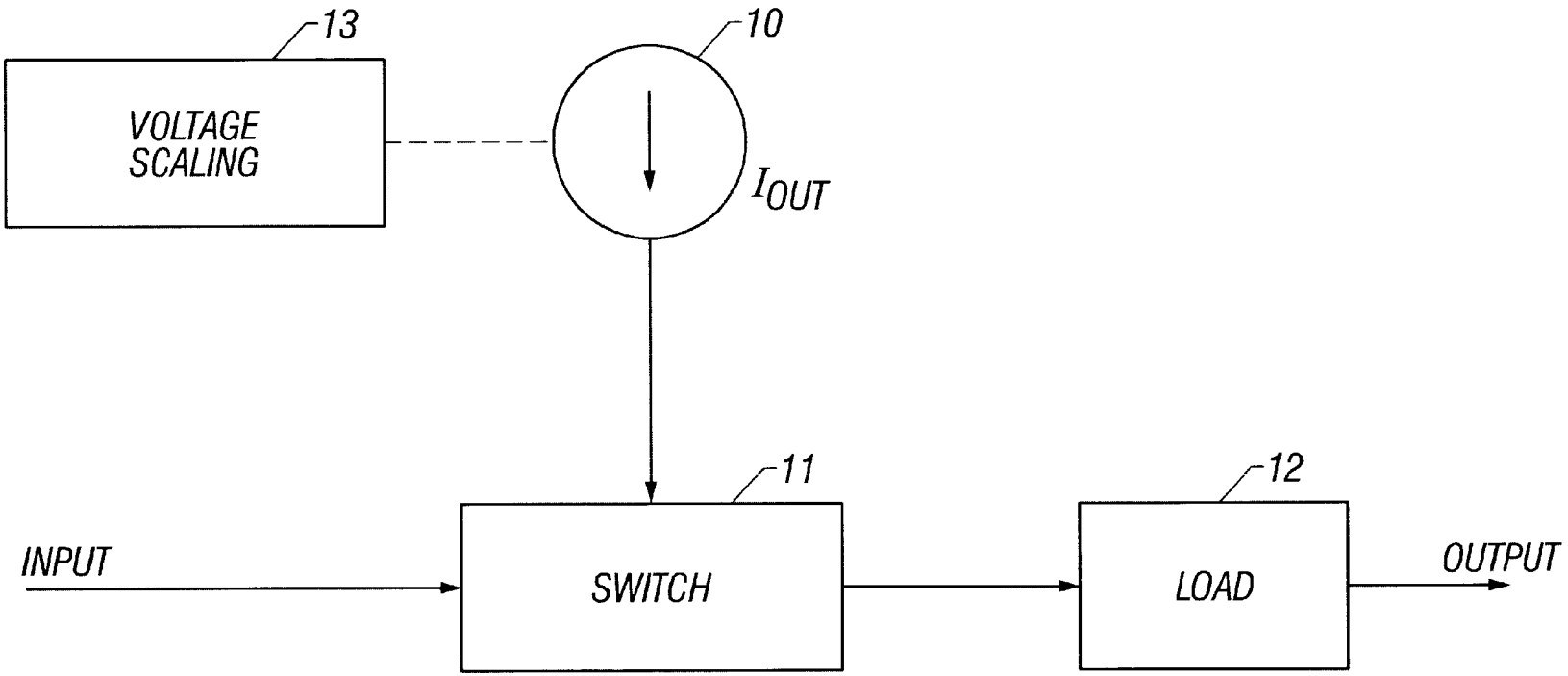
FIG. 1 is a block schematic diagram showing one embodiment of a high impedance current mode scalable driver of the present invention.

Referring to FIG. 1, a block schematic diagram showing one embodiment of the present invention is illustrated. A current reference or source 10, which provides a current $I_{out}$ provides a substantially constant driving current to switch 11. The switch 11 is driven by the current source 10 but is switched by an input signal coupled to the switch 11. The current $I_{out}$ is then coupled through the switch 11 to a load 12 by the switching operation controlled by the input signal (shown as INPUT). The load 12 provides appropriate loading to generate a voltage output (shown as OUTPUT), whenever the current $I_{out}$ is switched to the load 12 by the operation of the switch 11. In an embodiment described below, the switch 11 is comprised of symmetrical switches.

However, it is understood that a variety of switch designs can be implemented for switch 11 to practice the invention.

As noted in FIG. 1, a voltage scaling circuit 13 is used to scale the current so that the output signal developed across the load 12 is less in peak amplitude to the corresponding input signal coupled to the switch 11. The voltage scaling circuit 13 can be a separate circuit coupled to the current source 10 or, alternatively, could be part of the current source 10 itself. Accordingly, when the circuit of FIG. 1 is operational, voltage reduction of the input signal is obtained at the output. The circuit of FIG. 1 operates as a driver and provides voltage scaling, so that one supply voltage platform can drive a circuit operating a second supply voltage platform. For the embodiments described herein the second supply voltage platform (which is the driven platform) is illustrated operating at a lower supply voltage.

For example, utilizing an example circuitry in which a clock signal is coupled to a processor, a 3.3 volt clock signal from a clock generator chip can be coupled to operate with a processor having a processor core supply voltage of around 1.0 volt or below. The voltage scaling reduction is obtained by the voltage developed across the load 12 when current $I_{out}$ is switched onto the load by the operation of the switch 11. As noted above, the operation of the switch 11 is controlled by the input signal so that the output scaling is achieved for a given input to provide the voltage scaling.

The utilization of a substantially constant current source 10, which is immune to supply noise, allows for a drive of the load 12, which is then also made immune to supply noise. Furthermore, the constant current source 10 provides a high impedance drive at the output, allowing for various loads to be placed at the output without significantly loading the circuit, which loading could affect the signal at the output. Additionally, over-voltage protection at the output (which is the input to the driven circuit) is typically not necessary, since the switch 11 isolate the higher supply voltage of the input from the lower supply voltage driven circuit at the output.

Figure 2:
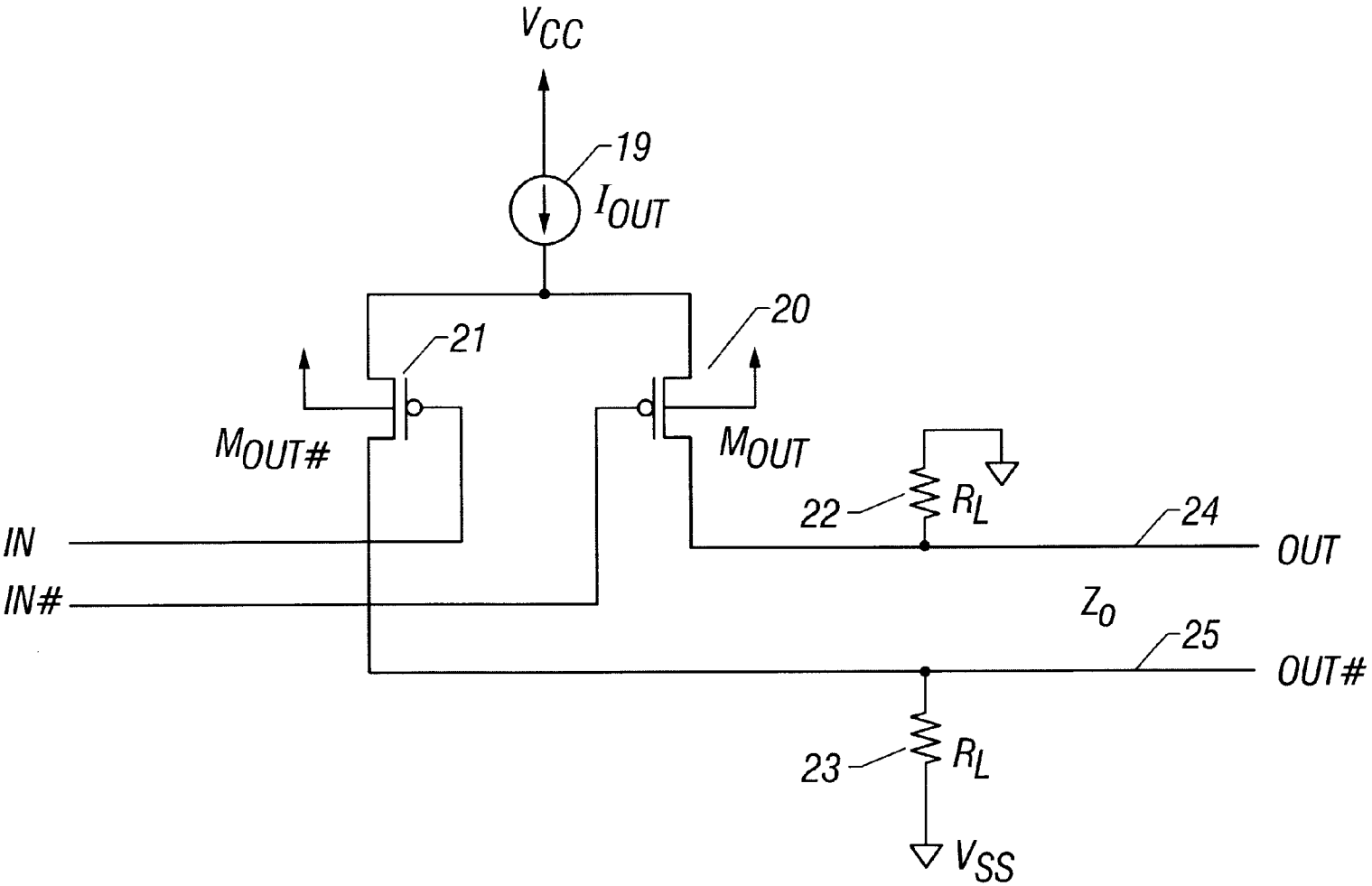
FIG. 2 is a circuit schematic diagram illustrating one embodiment of the scalable driver of the present invention.

One example embodiment of the driver circuitry of FIG. 1 is shown in FIG. 2. A current reference or source 19 is coupled to a parallel arrangement of P-type transistors 20, 21 (which are also referred to as $M_{out}$ and $M_{out}$#, the # used to designate a complement signal). The current source 19 is also coupled to a supply voltage Vcc. The output of the transistors 20, 21 are coupled respectively to a pair of output transmission lines 24, 25 to provide the output signals OUT and OUT#. The gates of the transistors 20, 21 are coupled to the input signals noted as IN and IN#. The two input signals in this instance are complementary signals in which the # indicates the complement signal. A pair of load resistors 22, 23 (noted as resistance $R_L$) are coupled to the respective output lines 24, 25. The other end of the resistors 22, 23 are coupled to the supply return Vss, which is shown as ground in the example.

In reference to FIG. 1, transistors 20, 21 correspond to the switch 11 and provide a symmetrical switching operation. The load resistors 22, 23 correspond to the load 12 and provide the loading function at the output. A current source 19 corresponds to the current source 10. The circuit of FIG. 2 has the current source 19 in series with the parallel arrangement of transistors 20, 21 to switch the current $I_{out}$ to drive the output lines 24 and 25. It is to be noted that $I_{out}$ is switched onto output line 24 by control of transistor 20 and $I_{out}$ is switched onto output line 25 by control of transistor 21. In the example, the output on lines 24, 25 is established as a differential output.

The coupling of $I_{out}$ onto the output lines 24, 25 results in a current flow through the load resistors 22, 23 so that a voltage is developed across the respective resistor 22, 23. Thus, when transistor 20 is biased to draw $I_{out}$ when IN# goes low, $I_{out}$ flows through resistor 22 developing a voltage equal to $I_{out}$ x $R_L$. A corresponding differential decrease is noted through transistor 21 and resistor 23. Alternatively, when transistor 21 is biased to draw $I_{out}$ when the input IN goes low, $I_{out}$ is switched onto line 25 developing a voltage $I_{out}$ x $R_L$ across the load 23.

In one embodiment, $I_{out}$ is set at 11 milliamps while the value of the load resistance $R_L$ is set at 50 ohms, so that a voltage of 0.55 volts (V) is developed across each of the load resistance $R_L$. When lines 24, 25 are treated differentially, a differential output swing of 0–0.55 can be developed across the output lines 24, 25. In another embodiment, 0.7V is developed across each $R_L$ to generate a 0–0.7 differential output swing. It is to be noted that the output signal can be configured as single-ended or differential. Since the transistors 20, 21 provide isolation between the input and the output, a driving circuit platform operating at a first supply voltage can be coupled at the input and a driven circuit platform operating at a second supply voltage can be coupled at the output 24, 25. For the implementation shown, the driven circuit has a lower supply voltage than the driver circuit.

Also, since the current source 19 provides a substantially constant current onto the output lines 24, 25, the circuit is generally immune from variations in the supply voltage. In typical usage, the load resistance $R_L$ is equal to the characteristic impedance $Z_0$ of the transmission line 24, 25. Thus, in the example noted above, $R_L$ has a value of 50 ohms which is also the characteristic impedance $Z_0$ of the lines 24, 25.

Figure 3:
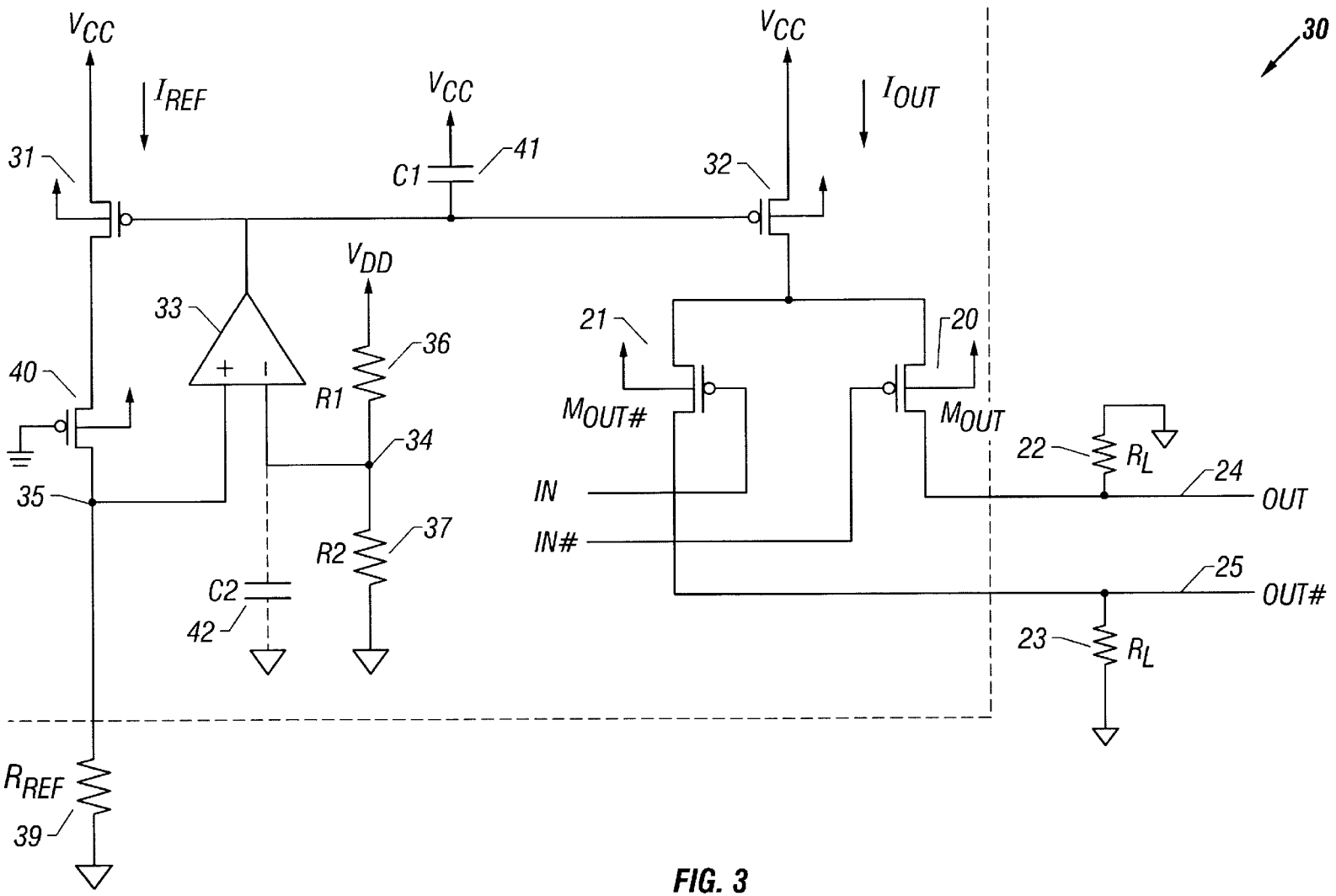
FIG. 3 is a more detailed circuit schematic diagram of an embodiment of the circuit of FIG. 2.

Referring to FIG. 3, a more detailed driver circuit 30 is illustrated in which a 3.3 volt supply (Vcc) platform provides a voltage reduction of at least 3 to 1 to drive a device having a supply voltage platform of around 1.0 volt or below. Without limiting the invention to these voltages, example voltages for the driven circuit can be in the range of 0.5–1.5V for one embodiment. In the circuit 30 of FIG. 3, the switching transistors and the load resistors are equivalent to those shown in FIG. 2. The current source 19 of FIG. 2 is functionally implemented by the current mirror transistors 31, 32. The reference current $I_{ref}$ flows through transistor 31 and the mirroring current $I_{out}$ flows through the mirror transistor 32. An operational amplifier (op amp) 33 operates as a voltage follower so that the voltage at the minus input of the op amp 33 (also noted as node 34) is impressed onto the plus input of the op amp 33 (also noted as node 35).

The voltage at node 34 is determined by a resistive voltage divider network comprised of resistors 36 and 37, which in the example have the resistance values of $R_l$ and $R_2$, respectively. By proper selection of the voltage division, a bias voltage is established at node 34, as well as node 35. This bias then sets the drive of the current mirror transistors 31, 32. The decoupling capacitor 41 ($C_l$) is used to decouple noise on the bias drive of transistors 31, 32. A second decoupling capacitor ($C_2$) can also be used at node 42. The biasing circuit of op amp 33 provides the voltage scaling circuit 13 noted in FIG. 1.

Accordingly, if the supply voltage of the first circuit is established at a given value, such as 3.3 volts, then some selected voltage value is chosen as a bias voltage to drive transistor 32. In the example circuit 30, resistors 36, 37 provide a voltage divider network ($R_l$, $R_2$) in which the voltage division of resistances $R_1$ and $R_2$, is noted at node 34 and correspondingly also at node 35. It follows then that the current $I_{ref}$ is determined by the voltage at node 35, divided by the resistance of a reference resistor 39 (noted as $R_{ref}$) The value of this biasing voltage is selected to obtain a desired $I_{ref}$ and correspondingly $I_{out}$.

Thus, by establishing corresponding voltages at nodes 34 and 35 and utilizing a particular value for the reference resistor 39, $I_{ref}$ can be selected to have a particular value. Then, due to the current mirror, $I_{out}$ would follow $I_{ref}$, in which the proportionate value of $I_{out}$ to $I_{ref}$ can be scaled utilizing a scaling factor. When current mirror transistors 31, 32 are identical, then it follows that $I_{out}$ will equal $I_{ref}$.

In the particular example circuit 30, the reference resistor ($R_{ref}$) 39 and the load resistors (RL) 22, 23 are shown external to a chip having the circuit 30 (the boundary of the chip is noted by the dotted line). It is appreciated that the load resistors $R_L$ and the reference resistor $R_{ref}$ can be implemented on chip, if desired. However, by allowing the $R_L$ and $R_{ref}$ to be placed external to the chip, various values of $R_L$ and $R_{ref}$ can be selected to provide the appropriate scaling of the output voltage. The additional transistor 40 operates as a dummy transistor. Since one of the switching transistors 20 or 21 is in series with the mirroring transistor 32, the dummy transistor 40 is placed in series with the $I_{ref}$ transistor 31 in order to provide symmetry in both legs of the current mirror circuit 30.

It is also noted that a variety of circuits can be utilized to generate the desired voltage at node 34. The voltage divider network shown in FIG. 3 is just but one example. Other circuitry, including bandgap circuits, can be utilized to provide a reference voltage at node 34. As will be noted below in the description of FIGS. 6 and 7, the reference voltage should be immune to noise and supply voltage variation, so that $I_{ref}$ and $I_{out}$ remain fairly constant.

In the example of FIG. 3, circuit 30 operates at the supply voltage of 3.3 volts. Accordingly, the circuit 30 would typically operate at the supply voltage of the higher supply voltage platform, such as a 3.3 volt clock generator. The output is coupled to a lower supply voltage platform, such as the approximate 1.1 volt platform of the processor. Thus, the driver circuit 30 need not operate at a lower supply voltage Vcc as the driver device but it does isolate the driven circuit coupled to the output lines 24, 25 so that the 3.3 volts is not impressed onto the output lines 24, 25. Furthermore, the substantially constant current $I_{out}$ provides a high impedance drive of the output lines 24, 25. It is also appreciated that the reference current $I_{ref}$ need only be derived once to drive a number of mirrored circuits to provide several sets of outputs.

Furthermore, the reference current $I_{ref}$ and the output current $I_{out}$ can be scaled to provide appropriate voltage scaling. One way to achieve this scaling is to select an appropriate reference resistor $R_{ref}$. Another technique to change the scaling is to change the physical dimensions of the transistors 31, 32 so that process and/or dimensional differences in these two transistors provide for the current scaling.

Figure 4:
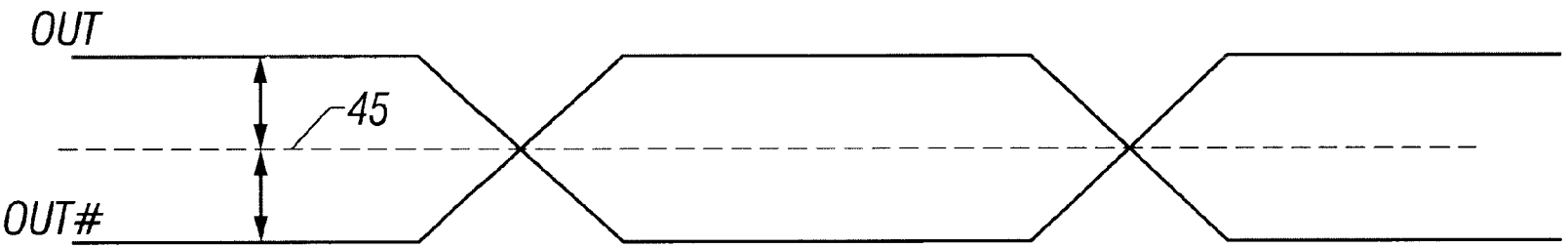
FIG. 4 illustrates one signal waveform diagram at the output of the scalable driver of FIG. 2.
Figure 5:
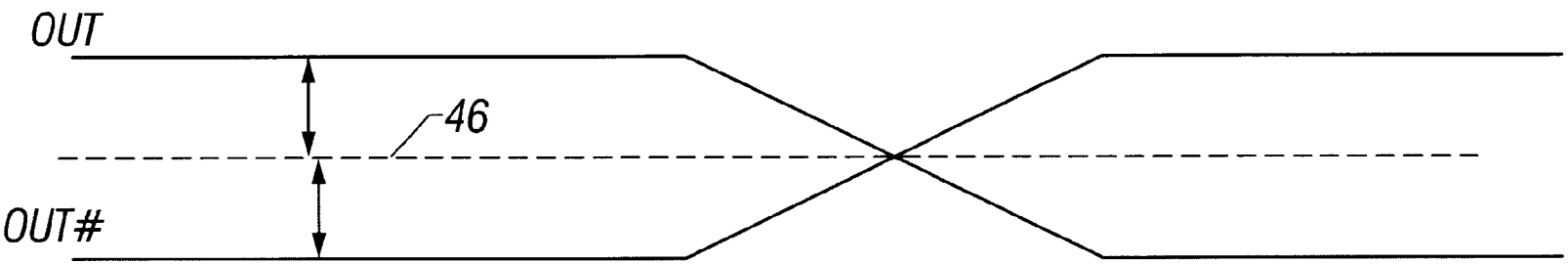
FIG. 5 illustrates another waveform diagram at the output of the scalable driver of FIG. 2.

FIG. 4 illustrates a waveform at the output. As noted in the waveform diagram, the signal at the output transitions about a mid-point 45 (which is shown by the dotted line). It is appreciated that if the slew rate of the circuit changes, which change is noted in the wave form of FIG. 5, the crossing point will still remain at the mid-point noted by line 46. The slew rate, noted by the slope of the signals when changing states, can change, but the crossover point will still remain at the mid point of the transitions. Thus, circuit 30 can be utilized to provide an output voltage swing which can vary substantially in peak voltage change but without affecting the relative crossover point of the signal. This ensures that signal state changes at the input of the drive circuit are not distorted at the output, even when experiencing changes in the slew rate.

Figure 6:
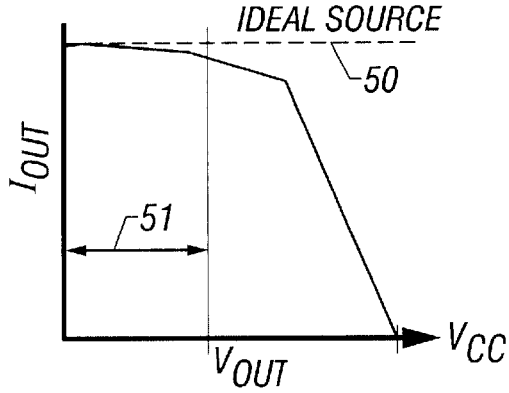
FIG. 6 is a graph illustrating the current $I_{out}$ versus $V_{out}$ for a range of Vcc in which an effective range of operation is defined as that portion having a substantially constant current.

FIG. 6 illustrates a graphic example in which the output current $I_{out}$ is graphed versus $V_{out}$. An ideal current source would generate a flat curve 50 for any output voltage $V_{out}$. However, in actual practice, the driver circuit has some amount of effective output impedance associated with changing the voltage on the transistors. Assuming that the transistors 20, 21, 32 of FIG. 3 are operating in saturation, the effective output impedance of the driver is high. The current is substantially constant in this effective range 51, which is shown in FIG. 6.

However, when the transistors 20, 21 leave saturation, then the changes in the output voltage of the driver are seen more directly by transistor 32 and the output impedance drops as shown in the portion just to the right of the effective range 51. When the transistor 32 drops out of saturation, then the changes in the output voltage of the driver are influenced more directly by the transistor 32 and the output impedance drops quickly as noted in the graph of FIG. 6. Thus, the biasing of the driver circuit 30 should be as such to keep $V_{out}$ in the effective range 51.

Figure 7:
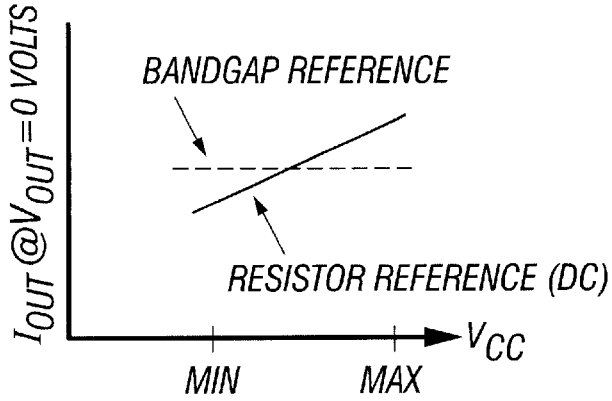
FIG. 7 is a graph illustrating the current $I_{out}$ (at $V_{out}$=0) versus Vcc to illustrate responses of $I_{out}$ for different current references.

Therefore, the design of the current reference will typically take into account the dependency on the supply voltage. If the reference voltage in the current reference of circuit 30 of FIG. 3 is some Vcc independent reference, such as a bandgap circuit, then the current is independent of Vcc. FIG. 7 shows a graph of $I_{out}$ (when $V_{out}$ is 0) versus Vcc. If the reference voltage in the current reference is Vcc dependent, such as a resistor divider circuit, then the DC current is directly dependent on the supply voltage. As shown in FIG. 7, a response of a bandgap circuit is relatively flat over the Vcc range of variation. However, the DC response of the resistor circuit is dependent on supply voltage variations.

Figure 8:
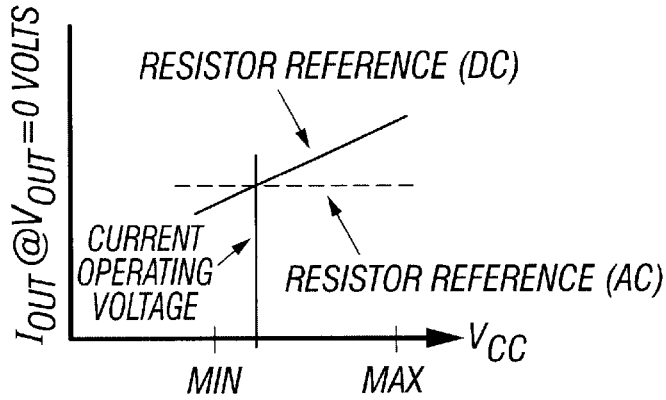
FIG. 8 is a graph illustrating the current $I_{out}$ (at $V_{out}$=0) versus Vcc to illustrate DC and AC responses of $I_{out}$ for resistive current references.

The Vcc variable current (due to the resistor reference) may potentially be a problem, if supply noise affected $I_{out}$ to cause jitter in the output signal. However, with high frequency bypassing, higher frequency noise components can be removed. As noted in FIG. 8, in a graph of $I_{out}$ (when $V_{out}$ is 0) versus Vcc, the AC response of a resistive reference source is substantially flat or constant, as compared to the DC response. The operative frequency range for noise rejection will be determined mostly by the op amp 33 and the capacitance values of the bypass capacitors, such as capacitors 41, 42. Accordingly, even with resistive current biasing, the reference current can provide a stabilized voltage at the output by providing rejection of AC noise.

Figure 9:
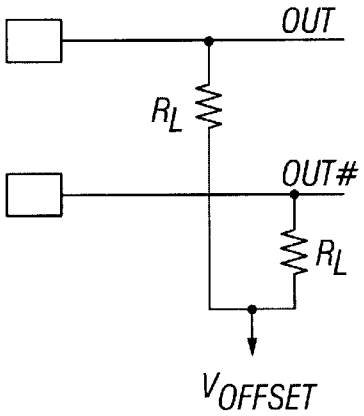
FIG. 9 is a circuit schematic diagram showing one embodiment of obtaining an offset voltage at the output of the scalable driver of the present invention.
Figure 10:
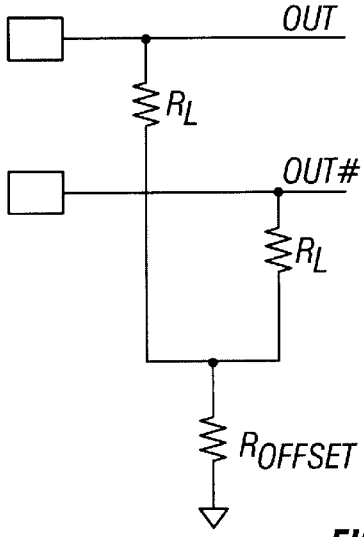
FIG. 10 is a circuit schematic diagram showing another embodiment of obtaining an offset voltage at the output of the scalable driver of the present invention.

Referring to FIG. 9, one circuit for implementing an offset voltage at the output is shown. In order to introduce an offset voltage, an offset noted as $V_{offset}$ is utilized. Instead of coupling $R_L$ to ground, the termination is made to the offset voltage. The actual value of the offset will be determined by the offset voltage. An equivalent offset can also be obtained by using an offset resistance noted by resistor $R_{offset}$, which is shown in FIG. 10. An offset resistance $R_{offset}$ is placed between ground and the junction of the load resistors $R_L$. The current $I_{out}$ flowing through the offset resistor generates a voltage which is equivalent to the voltage $V_{offset}$ in FIG. 9.

Figure 11:
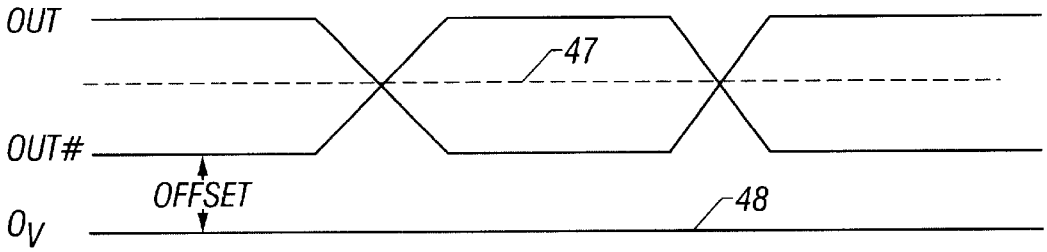
FIG. 11 is a waveform diagram illustrating the offset when the circuit of FIG. 9 or 10 is utilized to generate an offset.

FIG. 11 illustrates the result of utilizing such an offset. As noted in the waveform diagram of FIG. 11, the output signals OUT and OUT# are raised above the reference by the offset voltage imposed by the circuit in FIG. 9 or 10. It is appreciated that other circuits can be implemented to provide the offset voltage. The offset allows for voltage swings at the output having lower differential value, but having the crossover point (noted by dotted line 47) raised above the base threshold 48, which is ground in the example.

Figure 12:
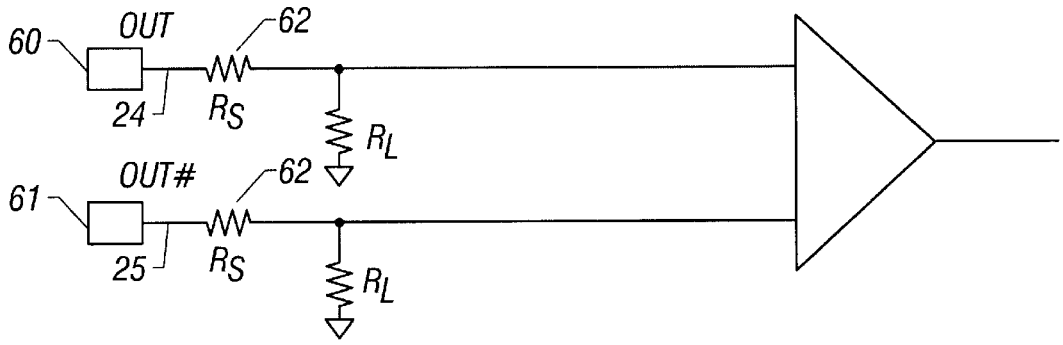
FIG. 12 is a circuit schematic diagram illustrating a use of a series resistor in the output line when the load resistor is placed near the scalable driver.
Figure 13:
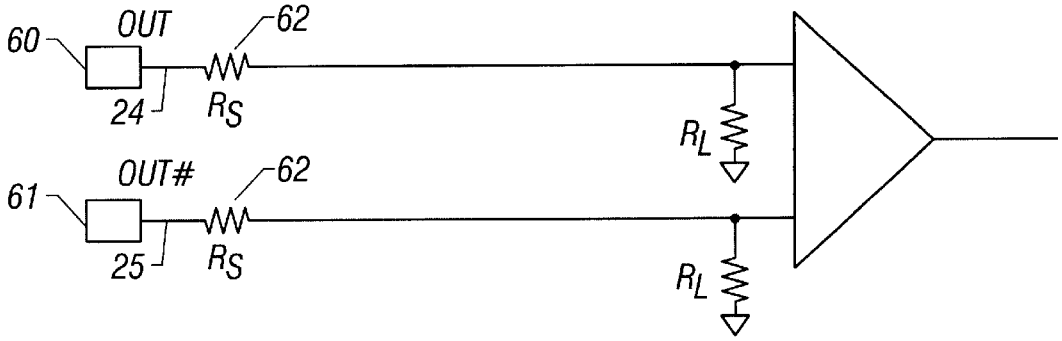
FIG. 13 is a circuit schematic diagram illustrating a use of a series resistor in the output line when the load resistor is placed far from the scalable driver.

FIGS. 12 and 13 also illustrate another embodiment of the present invention to provide a high AC driving impedance at the output. Assuming that the circuit in FIG. 3 is used to drive the output lines 24, 25, the load resistor RL can be placed anywhere along the transmission line. In FIG. 12, $R_L$ is placed close to output terminals 60, 61 of the voltage scaling circuit. In FIG. 13, RL is placed closer to the driven circuit and distant from the pads 60 and 61 of the driver circuit. A situation of this nature is encountered when the scaling circuit of the present invention is placed on a die of one chip and is coupled to the lower voltage platform chip across a distance. For example, the transmission line 24, 25 could be lines a circuit board coupling a clock chip to a processor chip. The scaled voltage output from the scaling circuit would then be transmitted to the processor chip over the lines present on the circuit board.

Thus, the load resistor $R_L$ could be placed in the vicinity of the scaling circuit or at the processor or anywhere along the transmission line 24, 25. In one embodiment, an external series resistance 62 (also noted as resistor $R_s$) is placed in series with the transmission lines 24, 25 and proximal to the pads 60, 61. In one embodiment where the characteristic impedance and the load resistance $R_L$ has a 50 ohm termination, $R_s$ is set at 33 ohms. The series resistance $R_s$ ensures that the capacitance on the terminal (pin) and silicon of the driver output is not visible to the network and essentially removes the silicon capacitance of the die from the transmission line. This ensures that the termination of the transmission line is achieved with less capacitance, which capacitance may be present due to the length of the transmission line from the wafer die. Thus, where capacitance may play a role in changing the AC impedance at the output of the scaling circuit, the series resistance $R_s$ reduces the effect of this capacitance on the transmission line.

Figure 14:
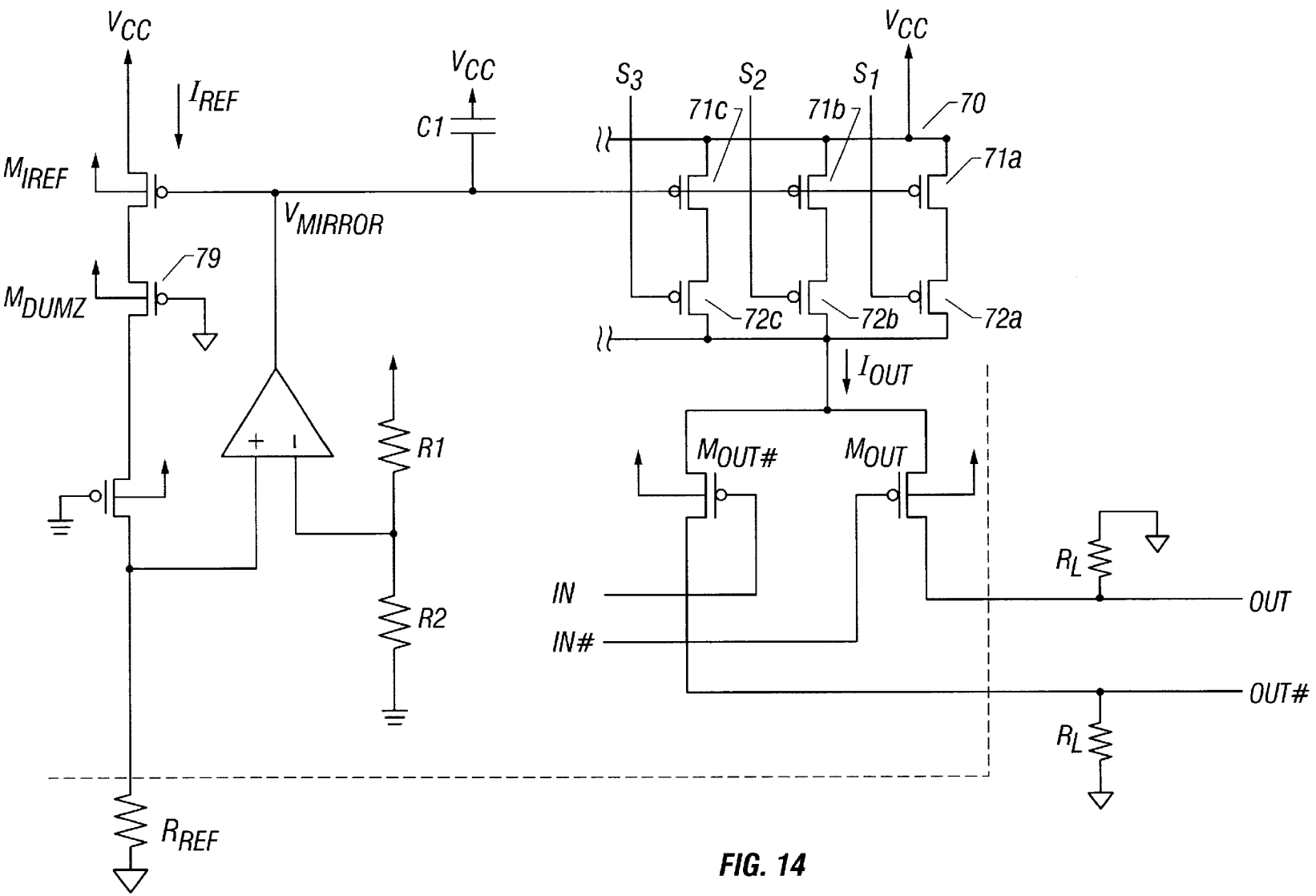
FIG. 14 is another embodiment of the present invention in which a transistor network is placed in the mirror leg of the current mirror of the circuit of FIG. 3 in order to provide programmable voltage scaling.

FIG. 14 shows another embodiment of the present invention in which programmable scaling is achieved for the scaling circuit shown in FIG. 3. The circuit shown in FIG. 14 is equivalent to the circuit of FIG. 3 except now there is present a scaling circuit 70 which is used to programmably select the value of the current $I_{out}$. In the example circuit, transistors 71 (shown as transistors 71*a*–72*c*) function as the current mirror transistor equivalent to transistor 32 of FIG. 3. Corresponding transistors 72 (72*a*–72*c*) in each leg of the network function as selection transistors, which are selected by the signal S1–S3.

It is appreciated that the selection signal can be coupled to operate in various different modes. For example, in one mode, transistors 72 operate with physical straps to turn on or turn off the transistor in each leg depending on the placement of the strap. In another mode, the selection signals are coupled to a programming source, such as a processor, so that the activation of each leg of the network 70 can be determined by a program. The programming can either set the activation status of each leg of the network 70 when the device is manufactured, at system power on, the processor can change the values on the fly.

With proper scaling of the transistors 71, the scaling between $I_{ref}$ and $I_{out}$ can be controlled by controlling the number of legs which are activated. It is appreciated that only three legs are shown in the network 70 but the actual number can vary depending on the type of scaling desired. A second dummy transistor 79 is also shown to balance the circuit. Furthermore, it is appreciated that the scaling network can be developed for the reference side of the current mirror. That is, an equivalent network can be put in place for the one current mirror transistor 31. In another embodiment, such networks can be employed at both the reference and the mirror side of the current mirror.

Accordingly, it is appreciated that a variety of techniques can be used to set the scaling between the reference current and the mirrored output current. However, generally, if such programmable network is to be used, it is generally utilized on the mirrored side so that $I_{ref}$ stays substantially constant no matter what the scaling. It is also appreciated that the scaling need not be at integer level and that fractional scaling is also available with the various voltage scaling techniques described herein.

Figure 15:
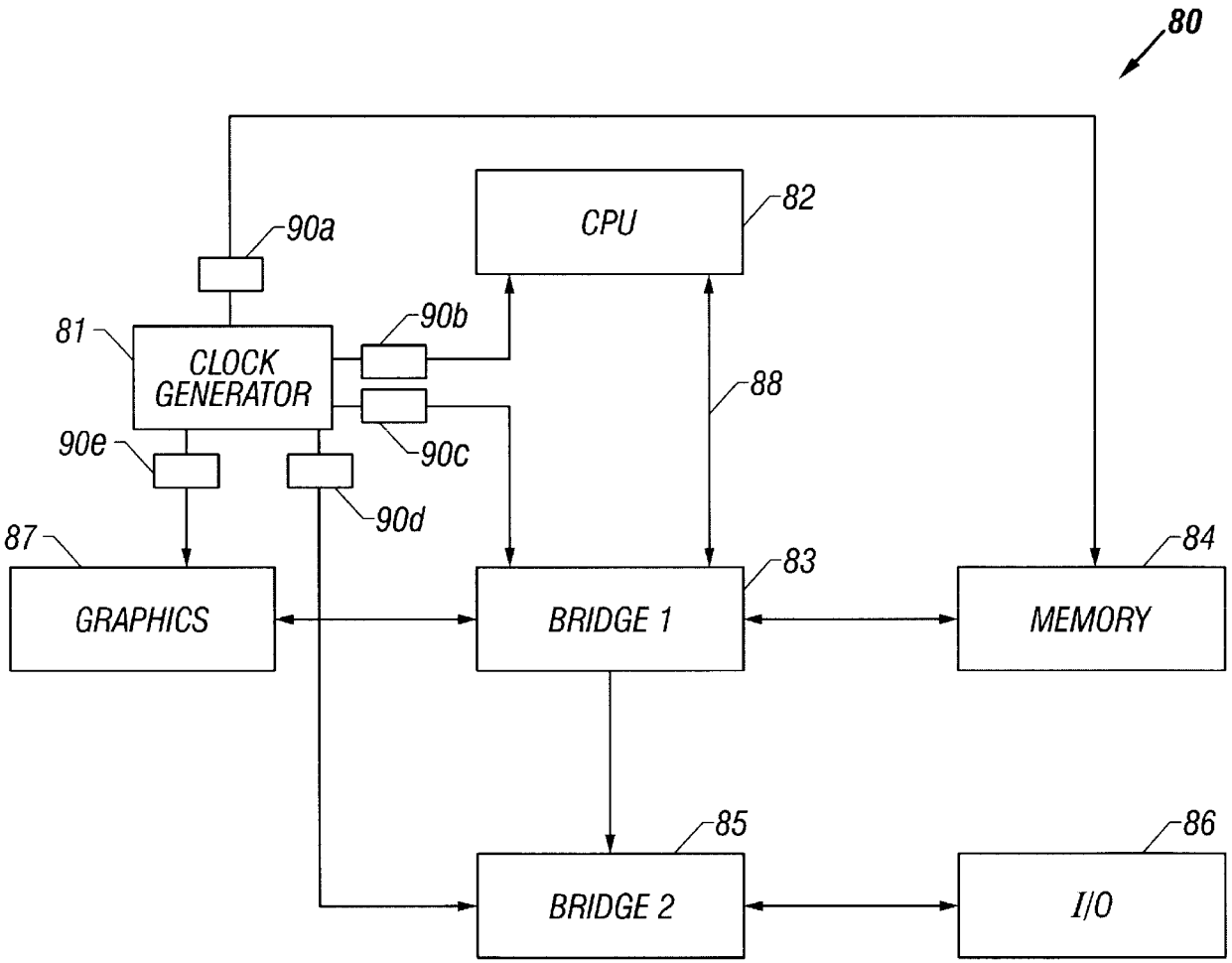
FIG. 15 is an example system level block diagram illustrating the use of the scalable driver to scale various clocking signals from a clock generator.

Referring to FIG. 15, a system level diagram is shown in which the scaling driver circuit of the present invention is utilized. In the exemplary system 80 shown in FIG. 15, a clock generator 81 is shown coupled to various devices in which clocking signals are generated and coupled to those various devices. As shown, one clocking signal is coupled to a central processing unit (CPU) 82. The CPU 82, a memory 84 and a graphics controller 87 are coupled to a bridge 83. The bridge 83 is also coupled to a second bridge 85 which couples to various input/output (I/O) devices 86.

As noted, various clock signals are generated by the clock generator 81 and coupled to the various circuits 82, 83, 84, 85, 86, 87. The scaling driver circuit of the present invention, shown by blocks 90*a*–*e* are utilized to generate necessary scaled clock signals to the functional components 82–87. It is to be noted that the functional components can be within the clock generator 81 or each individual components can be incorporated in the corresponding target unit.

Using the earlier described example, the clock generator 81 operates on a 3.3 volt supply voltage and the scaling driver circuit shown by circuit 90*b* scales the 3.3 volts to provide about 1.0v or below 1.0v clocking signal to the CPU 82. It is appreciated that the other scaling circuitry 90*a, c*–*e* shown in FIG. 15 may not be required if the receiving circuit operates at the same supply voltage level as the clock generator circuit 81. However, FIG. 15 does show that such scaling circuits 90 can be implemented for various devices of a system, such as a computer system. Although the various blocks 90*a*–*e* are shown separately, it is appreciated that the circuitry can be implemented as one circuit. As previously described, one reference current could supply a number of mirrored circuits to provide different voltages for the different devices shown.

Additionally, it is to be noted that the scaling circuit need not necessarily be employed with a clocking generator or clocking signals only. For example, if there are data transmissions between circuits operating at two different supply voltage platforms, then the scaling circuit can be utilized to provide the voltage scaling of data transmission. Thus, a data transfer between a CPU and some other component such as bridge 83 of FIG. 15 would be effected over a bus 88. In such circumstance, the scaling circuit could be implemented along bus 88 or at either end of bus 88 to ensure that proper signal scaling is achieved between platforms operating at two different supply voltages.

Various advantages are noted by the practice of the present invention. For example, voltage domain problems are eliminated when a platform component on a higher voltage process needs to drive a receiver, such as a CPU, which is on a lower core voltage platform. The invention allows the driver to drive at an arbitrarily low voltage necessary for the receiver. Low voltage and particularly differential application by the practice of the present invention allows superior EMI performance while lowering jitter and skew. The voltage scalability of the invention allows the platform device to drive a small voltage but still have a high Vcc compared to the driven device. The driven device does not require over voltage protection circuitry which would add timing and performance impact on the receiver. The invention also allows for alternative techniques of programming the scalability as well as utilizing an offset for specific applications.

Furthermore, the circuit provides a high impedance source which allows many termination options at the output without impedance discontinuity, including line length, independent source termination and mid-bus or end-bus driving. Source termination can be effectively implemented with an arbitrarily long line, unlike lower impedance drivers. The high impedance nature also allows drivers to be coupled in the middle of a bus and not affect the impedance of the line. The invention is also very easy to model with a linear model since it operates in a very linear region of the transistor curve, and furthermore, the circuitry for the invention can be implemented in CMOS (complimentary metal oxide semiconductor). Implementation in CMOS allows for inexpensive implementation of voltage scalability.

The circuit can be implemented for both differential applications as well as for single-ended applications. Although the invention can be utilized for various signals, one application utilizes the invention for generating clock signals. The scaling of the clock signals to operate on low supply voltage processors, such as the processors utilized in mobile computers, allows clock vendors to continue to produce inexpensive clock chips of older generation to operate with the more recent newer generation processors on low supply voltage platforms.

Thus, high impedance current mode voltage scalable driver is described.

We claim:

1. A driver circuit comprising:

a first transistor and a second transistor coupled in parallel to provide a differential output signal, said first and second transistors having their gates coupled to receive a differential input signal and in which said first and second transistors operate as a switch to have a voltage swing of the input signal reduced in amplitude to generate the output signal having less of a voltage swing than the input signal;

a third transistor and a fourth transistor arranged to form a current mirror to provide a reference current and a mirror current respectively, said fourth transistor coupled to said first and second transistors, in which the mirror current when coupled to a load generates the differential output signal; and a voltage scaling circuit coupled to said current mirror to establish a scaling voltage to establish scaling of signal reduction between the input signal and the output signal, the scaling voltage when coupled to a reference impedance establishes a value for the reference current.

2. The driver circuit of claim 1 wherein the input signal operates at a first supply voltage and the output signal is at second supply voltage which is lower than the first supply voltage.

3. The driver circuit of claim 2 wherein the input signal is a clocking signal received from a clocking device operating at the first supply voltage and the output signal is the clocking signal reduced in voltage to clock circuitry operating at a lower supply voltage than the clocking device.

4. The driver circuit of claim 3 wherein said first, second and fourth transistors present a sufficiently high impedance to maintain a substantially constant current over a range of voltages available for the output signal.

5. The driver circuit of claim 2 wherein said first, second and fourth transistors provide a sufficiently high impedance drive to a load at an operating range which maintains the mirror current substantially constant, even if variations of the first supply voltage occurs.

6. The driver circuit of claim 5 wherein said first and second transistors isolate the first supply voltage from the second supply voltage.

7. The driver circuit of claim 6 further including a plurality of transistors arranged in parallel to said fourth transistor to form a number of branches, wherein each branch is to be switched in to change the mirror current for a given reference current to change the voltage swing of the output signal.

8. A method comprising:

providing a substantially constant output current to a load to develop a voltage across the load as an output signal, the output current under control of a switch controlled by an input signal;

scaling the output current to develop the voltage across the load so that the output signal follows the input signal, but having less of a voltage swing to scale the output signal to the input signal at a predetermined ratio; and driving the load at sufficiently high impedance to maintain a substantially constant current over the range of voltage developed by the load.

9. The method of claim 8 wherein the input signal operates at a first supply voltage and the output signal is used to drive a circuit having a second supply voltage which is lower than the first.

10. The method of claim 9 wherein the input signal is a clocking signal received from a clocking circuit operating at the first supply voltage and the output signal is the clocking signal reduced in voltage to clock circuitry operating at the lower second supply voltage.

11. A system comprising:

a signal generation device operating at a first supply voltage;

a processor operating at a second supply voltage;

a signal level transitioning circuit coupled to said processor and said signal generation device to transition a signal from said signal generation device which is operating at the first supply voltage to be compatible with said processor operating at the second supply voltage which is less in magnitude than the first supply voltage, said signal transitioning level circuit comprising:

(a) a current source;

(b) a scaling circuit coupled to said current source to control a value of current from said current source; and (c) a switch coupled to said current source to switch said current on to a load, said switch being responsive to the input signal and in which the value of current through the load provides the output signal compatible to operate at the second supply voltage.

12. The system of claim 11 wherein said current source provides a high impedance drive to the load at an operating range which maintains the current substantially constant, even if variations of the first supply voltage occurs.

13. The system of claim 11 wherein said current source provides a high impedance drive to the load to provide noise rejection to maintain a substantially constant current over a specified voltage swing of the output signal.

14. The system of claim 11 where in said current source includes a current mirror coupled to said scaling circuit, in which said scaling circuit develops a voltage across an impedance to determine a reference current for said current mirror, the reference current used to establish a mirror current for said current mirror and the mirror current is then switched to the load.

15. The system of claim 14 wherein said scaling circuit uses a voltage reference to establish scaling of an input signal voltage swing to an output signal voltage swing to make the output signal compatible to operate at the second supply voltage.

16. An apparatus comprising:

a first transistor and a second transistor coupled in parallel to provide an output signal across output lines of said first and second transistors, said first and second transistors having their gates coupled to receive an input signal and its complement operating at a first supply voltage and in which said first and second transistors operate as a switch in response to the input signal and its complement;

a current source coupled to said first and second transistors to source a reference current to said first and second transistors and in which the reference current, when coupled as the output signal to a load, develops a scaled voltage in response to the input signal, said current source to establish scaling of the scaled voltage across the load to have less of a voltage swing than the input signal.

17. The apparatus of claim 16 wherein the input signal is a clocking signal operating at the first supply voltage and the output signal is the clocking signal reduced in voltage to clock circuitry operating at a second supply voltage.

18. The apparatus of claim 16 wherein said current source provides a high impedance drive to the load at an operating range which maintains the current substantially constant, even if variations of the first supply voltage occurs.

19. The apparatus of claim 16 wherein said current source provides a high impedance drive to the load to provide noise rejection to maintain a substantially constant current over a specified voltage swing of the output signal.

20. The apparatus of claim 16 wherein said first and second transistors isolate the first supply voltage from the load.

* * * * *